US009031436B2

(12) United States Patent
Shimizu et al.

(10) Patent No.: US 9,031,436 B2
(45) Date of Patent: May 12, 2015

(54) IMAGE FORMING APPARATUS

(75) Inventors: Yasunobu Shimizu, Kanagawa (JP); Hiroyoshi Haga, Kanagawa (JP); Tomokazu Takeuchi, Tokyo (JP); Hiromi Ogiyama, Tokyo (JP); Kenji Sengoku, Kanagawa (JP); Junpei Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 192 days.

(21) Appl. No.: 13/477,724

(22) Filed: May 22, 2012

(65) Prior Publication Data

US 2012/0308250 A1 Dec. 6, 2012

(30) Foreign Application Priority Data

Jun. 2, 2011 (JP) ..... 2011-124141
Aug. 19, 2011 (JP) ..... 2011-179488

(51) Int. Cl.
*G03G 15/16* (2006.01)

(52) U.S. Cl.
CPC .... *G03G 15/1645* (2013.01); *G03G 2215/0129* (2013.01)

(58) Field of Classification Search
USPC ..... 399/66, 302, 308
See application file for complete search history.

(56) References Cited

U.S. PATENT DOCUMENTS 4,134,147 A * 1/1979 Watanabe ..... 361/235
4,190,348 A 2/1980 Friday
4,528,937 A 7/1985 Kanno et al.
4,851,874 A 7/1989 Ogiyama
5,029,840 A 7/1991 Haga et al.
5,408,300 A * 4/1995 Wataki et al. ..... 399/313
5,483,330 A 1/1996 Ogiyama et al.
5,991,570 A 11/1999 Haga et al.
6,405,002 B2 6/2002 Ogiyama et al.
6,618,565 B2 9/2003 Tamiya et al.

(Continued)

FOREIGN PATENT DOCUMENTS

JP 4-86878 3/1992
JP 9-146381 6/1997

(Continued)

OTHER PUBLICATIONS

Extended European Search Report issued Sep. 21, 2012, in Application No. / Patent No. 12169698.3-2216.

(Continued)

*Primary Examiner* — Gregory H Curran
(74) *Attorney, Agent, or Firm* — Oblon, McClelland, Maier & Neustadt, L.L.P.

(57) ABSTRACT

An image forming apparatus, includes an image bearer to bear a toner image; a transfer member to transfer the toner image; a transfer bias applicator to apply a transfer bias to the transfer member, the transfer bias applicator including a direct current voltage source to apply a direct current transfer bias constituted by a direct current voltage to the transfer member; and a superimposed voltage source to apply a superimposed transfer bias in which an alternating current voltage is superimposed on a direct current voltage to the transfer member; and a controller to switch between a direct current transfer mode during which the direct current transfer bias is applied to transfer the toner image and a superimposed transfer mode during which the superimposed transfer bias is applied to transfer the toner image while the direct current voltage source and the superimposed voltage source are off.

25 Claims, 9 Drawing Sheets

SECONDARY TRANSFER:
DC CONSTANT CURRENT
CONTROL/VOLTAGE DETECT

(56) References Cited

U.S. PATENT DOCUMENTS

| | | | | |
|---|---|---|---|---|
| 6,697,595 | B2 | 2/2004 | Kawagoe et al. | |
| 6,741,821 | B2 | 5/2004 | Sugino et al. | |
| 6,785,500 | B2 | 8/2004 | Takahashi et al. | |
| 6,829,450 | B2 | 12/2004 | Tamiya et al. | |
| 6,901,234 | B2 | 5/2005 | Ogiyama et al. | |
| 7,003,238 | B2 | 2/2006 | Yoshida et al. | |
| 7,203,433 | B2 | 4/2007 | Kato et al. | |
| 7,277,657 | B2 | 10/2007 | Uchida et al. | |
| 7,280,792 | B2 | 10/2007 | Sawai et al. | |
| 7,346,287 | B2 | 3/2008 | Ogiyama et al. | |
| 7,610,004 | B2 | 10/2009 | Kato et al. | |
| 7,773,928 | B2 | 8/2010 | Ogiyama et al. | |
| 8,135,319 | B2 | 3/2012 | Fujita | |
| 8,145,091 | B2 * | 3/2012 | Inada | 399/101 |
| 2003/0118359 | A1 | 6/2003 | Ogiyama et al. | |
| 2008/0232867 | A1 | 9/2008 | Minbu et al. | |
| 2010/0040386 | A1 | 2/2010 | Mizutani et al. | |
| 2010/0067952 | A1 | 3/2010 | Fujita et al. | |
| 2010/0080631 | A1 | 4/2010 | Ogiyama et al. | |
| 2010/0098446 | A1 | 4/2010 | Ishikawa et al. | |
| 2010/0142985 | A1 | 6/2010 | Minbe et al. | |
| 2010/0221029 | A1 | 9/2010 | Minbu et al. | |
| 2011/0064487 | A1 | 3/2011 | Ichihashi et al. | |
| 2011/0158690 | A1 | 6/2011 | Mimbu et al. | |
| 2011/0181116 | A1 | 7/2011 | Takeuchi et al. | |
| 2011/0206399 | A1 | 8/2011 | Fujita et al. | |
| 2011/0286759 | A1 | 11/2011 | Ichihashi et al. | |
| 2011/0293312 | A1 | 12/2011 | Mimbu et al. | |
| 2012/0008991 | A1 | 1/2012 | Shimizu | |
| 2012/0045237 | A1 | 2/2012 | Aoki et al. | |
| 2012/0213536 | A1 | 8/2012 | Takeuchi | |
| 2012/0224879 | A1 | 9/2012 | Fujita et al. | |
| 2012/0230715 | A1 | 9/2012 | Ogino et al. | |
| 2012/0237260 | A1 | 9/2012 | Sengoku et al. | |
| 2012/0237271 | A1 | 9/2012 | Sengoku et al. | |
| 2012/0315058 | A1 | 12/2012 | Shimizu et al. | |
| 2012/0328320 | A1 | 12/2012 | Fujita et al. | |
| 2013/0004190 | A1 | 1/2013 | Sengoku et al. | |

FOREIGN PATENT DOCUMENTS

| | | |
|---|---|---|
| JP | 2002-072588 | 3/2002 |
| JP | 2003-118158 | 4/2003 |
| JP | 2006-267486 | 10/2006 |
| JP | 2008-58585 | 3/2008 |
| JP | 2010-281907 | 12/2010 |

OTHER PUBLICATIONS

Office Action issued on Sep. 16, 2014 in Japanese Patent Application No. 2011-179488.

* cited by examiner

SECONDARY TRANSFER:
DC CONSTANT CURRENT
CONTROL/VOLTAGE DETECT

SECONDARY TRANSFER:
AC SUPERIMPOSED
TRANSFER CONTROL

IMAGE FORMING APPARATUS

CROSS-REFERENCE TO RELATED APPLICATIONS

This patent application is based on and claims priority pursuant to 35 U.S.C. §119 to Japanese Patent Application Nos. 2011-124141, filed on Jun. 2, 2011 and 2011-179488, filed on Aug. 19, 2011 in the Japan Patent Office, the entire disclosures of which are hereby incorporated by reference herein.

FIELD OF THE INVENTION

1. Technical Field

The present disclosure relate to an image forming apparatus, such as a copier, a facsimile machine, a printer, or a multi-functional system including a combination thereof.

2. Description of the Related Art

In electrophotographic image forming apparatuses, an electrostatic latent image, which is obtained by forming optical image data on an image carrier (e.g., a photoreceptor) that is uniformly charged in advance, is rendered visible with toner from a development device. An image is formed on a recording medium by transferring the visible image directly or indirectly onto the recording medium (e.g., transfer sheet) via an intermediate transfer member and fixing the image thereon.

In a thus-configured image forming apparatus, a constant current control method to control a direct current (DC) transfer bias applied to a transfer member using a direct current (DC) power source is widely used. In constant current control, an output voltage from a bias application circuit is detected by a detection circuit provided to the bias application circuit, and a resistance of a transfer roller side (i.e., resistance including the image carrier and the recording medium) is calculated based on the detected output voltage to determine a transfer current value.

At present, various types of recording media, for example, waved laser-like paper having premium accent or Japanese paper, are widely sold. In these papers, in order to create luxurious mode, surfaces of the papers have asperities with embossed effect. The toner in a concave portion of the paper is hardly transferred, compared to a convex portion thereof. More particularly, when the toner is transferred on the recording medium having large asperity, the toner cannot be transferred on the concave portion sufficiently, which may generate image failure in which toner image is partly absent.

In order to solve the transfer failure in the concave portion of the recording media, the related art discloses an approach in which a superimposed bias in which an alternating current (AC) voltage is superimposed on a direct current (DC) voltage is applied, and as a result, transfer efficiency is improved and image failure alleviated. In this configuration, in order to switch between the DC transfer mode and the superimposed transfer mode, the image forming apparatus has a DC power source to apply a DC transfer bias and a superimposed power source (AC+DC power source) to apply the superimposed bias.

Accordingly, the transfer mode is switched between a DC transfer mode and a superimposed transfer mode in which the AC voltage is superimposed on the DC voltage, in accordance with the types of recording media used, which provides the preferred transfer efficiency for the various types of recording media.

However, when the transfer mode is switched in this example, a current from one power source may reversely flow to the other power source, which causes the image forming apparatus to malfunction and damage to a substrate of the power sources. Assuming generation of the reverse current, the power source is designed to be highly durable, thereby increasing cost dramatically.

JP-2010-281907-A proposes a configuration in which a normal bias and a reverse bias are switched. In this example, a single power source is provided in the other power source, and bias switching is performed in a single transfer mode (for example, only superimposed bias applying mode in which the AC voltage is superimposed on the DC voltage).

SUMMARY

In one aspect of this disclosure, there is provided an image forming apparatus including an image bearer to bear a toner image; a transfer member to transfer the toner image; a transfer bias applicator to apply a transfer bias to the transfer member, and a controller. The transfer bias applicator includes a direct current voltage source to apply a direct current transfer bias constituted by a direct current voltage to the transfer member; and a superimposed voltage source to apply a superimposed transfer bias in which an alternating current voltage is superimposed on a direct current voltage to the transfer member. The controller switches between a direct current transfer mode during which the direct current transfer bias is applied to transfer the toner image and a superimposed transfer mode during which the superimposed transfer bias is applied to transfer the toner image while the direct current voltage source and the superimposed voltage source are off.

BRIEF DESCRIPTION OF THE DRAWINGS

The aforementioned and other aspects, features, and advantages will be better understood by reference to the following detailed description when considered in connection with the accompanying drawings, wherein.

DETAILED DESCRIPTION OF PREFERRED EMBODIMENTS

Figure 1:
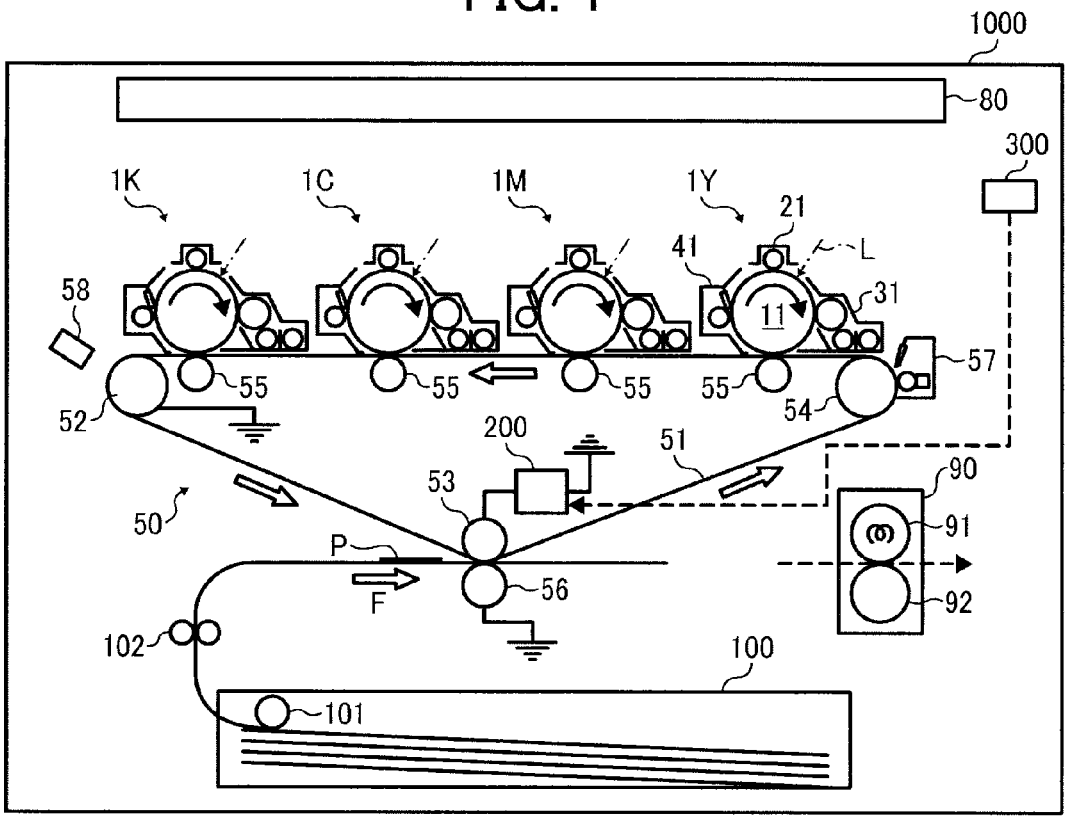
FIG. 1 is a schematic diagram illustrating an image forming apparatus according to the present disclosure.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, particularly to FIGS. 1 through 11, image forming apparatus according to illustrative embodiments are described. It is to be noted that although the image forming apparatus of the present embodiment is described as a printer, the image forming apparatus of the present invention is not limited thereto. In addition, it is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

(Configuration of Image Forming Apparatus)

FIG. 1 is a schematic diagram illustrating a color printer as an example of the image forming apparatus 1000 according to an illustrative embodiment of the present invention. As illustrated in FIG. 1, the image forming apparatus 1000 includes four image forming units 1Y, 1M, 1C, and 1K for forming toner images, one for each of the colors yellow, magenta, cyan, and black, respectively, a transfer unit 50, an optical writing unit 80, a fixing device 90, a sheet cassette 100, and a pair of registration rollers 102. The image forming apparatus 1000 includes an endless belt (intermediate transfer belt 51) as an intermediate transfer member. The four image forming units 1Y, 1M, 1C, and 1K for forming toner images are provided aligned to an upper portion of the intermediate transfer belt 51, which forms a tandem image forming unit.

It is to be noted that the suffixes Y, M, C, and K denote colors yellow, magenta, cyan, and black, respectively. To simplify the description, these suffixes Y, M, C, and K indicating colors are omitted herein, unless otherwise specified. The image forming units 1Y, 1M, 1C, and 1K all have the same configuration, differing only in the color of toner employed. Thus, a description is provided below of the image forming unit 1K for forming a toner image of black as a representative example of the image forming units 1. The image forming units 1Y, 1M, 1C, and 1K are replaceable, and are replaced upon reaching the end of their product life cycles.

Figure 2:
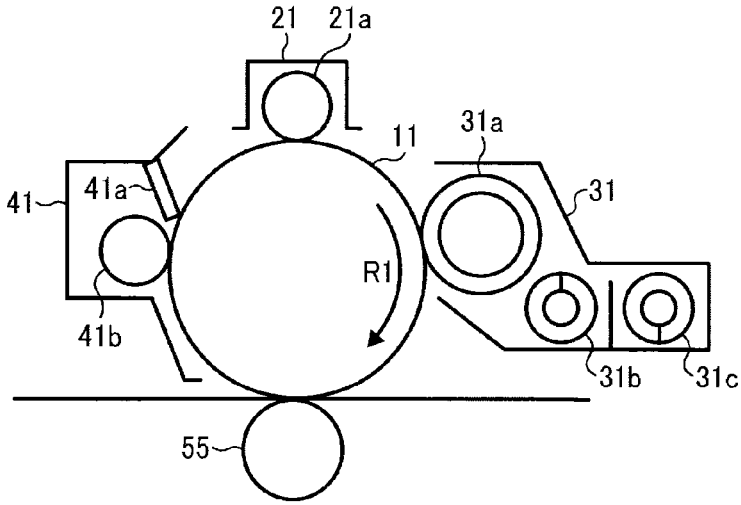
FIG. 2 is a schematic diagram illustrating an image forming unit included in the image forming apparatus shown in FIG. 1.

With reference to FIG. 2, a description is provided of the image forming unit 1K as an example of the image forming units 1. FIG. 2 is a schematic diagram illustrating the image forming unit 1K. A photoconductive drum 11K serving as a latent image bearing member is surrounded by various pieces of imaging equipment, such as a charging device 21, a developing device 31, a drum cleaner 41, and a charge neutralizing device (not illustrated). These devices are held by a common holder so that they are detachably attachable and replaced at the same time.

The photoconductive drum 11K essentially consists of a drum-shaped base on which an organic photoconductive layer is disposed, with the external diameter of approximately 60 mm. The photoconductive drum 11K is rotated in a clockwise direction (indicated by arrow R1 in FIG. 2) by a driving device. The charging device 21K includes a charging roller 21*a* supplied with a charging bias. The charging roller 21*a* contacts or approaches the photoconductive drum 11 to generate an electrical field therebetween, thereby charging uniformly the surface of the photoconductive drum 11. According to the illustrative embodiment, the photoconductive drum 11 is uniformly charged to a negative polarity which is the same charging polarity as toner.

As the charging bias, an alternating current voltage superimposed on a direct current voltage is employed. The charging roller 21*a* comprises a metal bar (core metal) coated with a conductive elastic layer made of a conductive elastic material. Alternatively, a corona charger may be employed instead of the charging roller 21*a*.

The developing device 31 includes a developing sleeve 31 serving as a developer carrier, screw conveyors 31*b* and 31*c* to mix a developer for black and transports the developing agent. It is to be noted that although two-component developer including toner and carrier is used in the above-described embodiments, the development device 31 may contain only single-component developer consisting essentially of only toner.

The drum cleaner 41 includes a cleaning blade 41*a* and a brush roller 41*b*. The brush roller 41*b* rotates and brushes off the residual toner from the surface of the photoconductive drum 11 while the cleaning blade 41*a* removes the residual toner by scraping. A charge neutralizer removes residual charge remaining on the photoconductive drum 11K after the surface thereof is cleaned by the drum cleaner 41 in preparation for the subsequent imaging cycle.

Referring again to FIG. 1, the optical writing unit 80 for writing a latent image on the photoconductive drums 11 is disposed above the image forming units 1Y, 1M, 1C, and 1K. Based on image information received from an external device such as a personal computer (PC), the optical writing unit 80 illuminates the photoconductive drums 11Y, 11M, 11C, and 11K with a light beam projected from a laser diode of the optical writing unit 80. Accordingly, the electrostatic latent images of yellow, magenta, cyan, and black are formed on the photoconductive drums 11Y, 11M, 11C, and 11K, respectively.

More specifically, the electrical potential of the portion of the charged surface of the photoconductive drum 11 illuminated with the light beam is attenuated. The electrical potential of the illuminated portion of the photoconductive drum 11 is less than the electrical potential of the other area, that is, the background portion (non-image portion), thereby forming the electrostatic latent image on the photoconductive drum 11.

The optical writing unit 80 includes a polygon minor rotated by a polygon motor, a plurality of optical lenses, and mirrors. The light beam projected from the laser diode serving as a light source is deflected in a main scanning direction by the polygon mirror. The deflected light then strikes the optical lenses and mirrors, thereby scanning the photoconductive drum 11. The optical writing unit 80 may employ a light source using an LED array including a plurality of LEDs that project light.

Referring back to FIG. 1, a description is provided of the transfer unit 50. The transfer unit 50 is disposed below the image forming units 1Y, 1M, 1C, and 1K. The transfer unit 50 includes the intermediate transfer belt 51 serving as an image bearer formed into an endless loop and rotated in the counterclockwise direction. The transfer unit 50 also includes a driving roller 52, a secondary-transfer rear roller 53, a cleaning backup roller 54, an nip forming roller 56, a belt cleaning device 57, an electric potential detector 58, four primary transfer rollers 55Y, 55M, 55C, and 55K, and so forth.

The intermediate transfer belt 51 is entrained around and stretched taut between the driving roller 52, the secondary-transfer rear roller 53, the cleaning backup roller 54, and the primary transfer rollers 55Y, 55M, 55C, and 55K (hereinafter collectively referred to as the primary transfer rollers 55, unless otherwise specified). The driving roller 52 is rotated in the counterclockwise direction by a motor or the like, and rotation of the driving roller 52 enables the intermediate transfer belt 51 to rotate in the same direction.

The intermediate transfer belt 51 of the present embodiment is made of a resin such as polyimide resin in which carbon is dispersed and has a thickness in a range of from 20 μm to 200 μm, preferably approximately 60 μm. The volume resistivity thereof is in a range of from 1e6 Ωcm to 1e12 Ωcm, preferably approximately 1e9 Ωcm. The volume resistivity is measured with an applied voltage of 100V using a high resistivity meter, in this case a Hiresta UPMCPHT 45 manufactured by Mitsubishi Chemical Corporation.

The intermediate transfer belt 51 is interposed between the photoconductive drums 11 and the primary transfer rollers 55. Accordingly, a primary transfer nip is formed between the outer surface of the intermediate transfer belt 51 and the photoconductive drums 11. The primary transfer rollers 55 are supplied with a primary bias by a transfer bias power supply 200, thereby generating a transfer electric field between the toner images on the photoconductive drums 11 and the primary transfer rollers 55.

The toner image Y of yellow formed on the photoconductive drum 11Y enters the primary transfer nip as the photoconductive drum 11Y rotates. Subsequently, the toner image Y is transferred from the photoconductive drum 11Y to the intermediate transfer belt 51 by the transfer electrical field and the nip pressure. As the intermediate transfer belt 51 on which the toner image of yellow is transferred passes through the primary transfer nips of magenta, cyan, and black, the toner images on the photoconductive drums 11M, 11C, and 11K are superimposed on the toner image Y of yellow, thereby forming a composite toner image on the intermediate transfer belt 51 in the primary transfer process.

In the case of monochrome imaging, a support plate supporting the primary transfer rollers 55Y, 55M, and 55C of the transfer unit 50 is moved to separate the primary transfer rollers 55Y, 55M, and 55C from the photoconductive drums 11Y, 11M, and 11C. Accordingly, the outer surface of the intermediate transfer belt 51, that is, an image bearing surface, is separated from the photoconductive drums 11Y, 11M, and 11C, so that the intermediate transfer belt 51 contacts only the photoconductive drum 11K. In this state, the image forming unit 1K is activated to form a black toner image on the photoconductive drum 11K.

In the present embodiment, each of the primary transfer rollers 55 is constituted of an elastic roller including a metal bar on which a conductive sponge layer is provided. The total external diameter thereof is approximately 16 mm. The diameter of the metal bar alone is approximately 10 mm. The electrical resistance of the sponge layer is measured in a state in which a metal roller having an outer diameter of 30 mm is pressed against the sponge layer at a load of 10N and a voltage of 1000V is supplied to the metal bar of the primary transfer roller 55. The resistance is obtained by Ohm's law R=V/I, where V is voltage, I is current, and R is resistance. The obtained resistance R of the sponge layer is approximately 3E7Ω. The primary transfer rollers 55 described above are supplied with the primary transfer bias through constant current control. According to this embodiment, a roller-type primary transfer device is used as the primary transfer roller 55. Alternatively, a transfer charger, a brush-type transfer device, and so forth may be employed as a primary transfer device (see FIG. 12).

The nip forming roller 56 of the transfer unit 50 is disposed outside the loop formed by the intermediate transfer belt 51, opposite the secondary-transfer rear roller 53. The intermediate transfer belt 51 is interposed between the secondary-transfer rear roller 53 and the nip forming roller 56, thereby forming a secondary transfer nip between the outer surface of intermediate transfer belt 51 and the nip forming roller 56. The nip forming roller 56 is electrically grounded. The secondary-transfer rear roller 53 is supplied with a secondary transfer bias from a secondary transfer bias power supply 200.

With this configuration, a secondary transfer electric field is formed between the secondary-transfer rear roller 53 and the nip forming roller 56 so that the toner of negative polarity is transferred electrostatically from the secondary-transfer rear roller 53 side to the nip forming roller 56 side.

The sheet cassette 100 storing a stack of recording media sheets is disposed beneath the transfer unit 50. The sheet cassette 100 is equipped with a sheet feed roller 101 to contact a top sheet of the stack of recording media sheets. At the end of a sheet passage, the pair of registration rollers 102 is disposed. As the sheet feed roller 101 is rotated at a predetermined speed, the sheet feed roller 101 picks up the top sheet of the recording medium P and sends it to the sheet passage. Then, the pair of registration rollers 102 stops rotating temporarily as soon as the recording medium P is interposed therebetween. The pair of registration rollers 102 starts to rotate again to feed the recording medium P to the secondary transfer nip in appropriate timing such that the recording medium P is aligned with the composite toner image formed on the intermediate transfer belt 51 in the secondary transfer nip.

In the secondary transfer nip, the recording medium P tightly contacts the composite toner image on the intermediate transfer belt 51, and the composite toner image is transferred onto the recording medium P by the secondary transfer electric field and the nip pressure applied thereto. The recording medium P on which the composite color toner image is formed passes through the secondary transfer nip and separates from the nip forming roller 56 and the intermediate transfer belt 51 by self striping.

The secondary-transfer rear roller 53 is formed by a metal bar (core metal) on which a resistive layer is laminated. The metal bar is made of stainless steel, aluminum, or the like. The resistive layer is formed of a polycarbonate, fluoro rubber, or silicone rubber, in which conductive particles (e.g., carbon and metal compound) are dispersed. Alternatively, the resistive layer may be formed of semi-conductive rubber, for example, polyurethane, nitirile rubber (NBR), ethylene propylene rubber, (EPDM), or friction rubber NBR/ECO (epichlorohydrin rubber). A volume resistivity of the resistive layer is in a range of from $10^6\Omega$ to $10^{12}\Omega$, preferably from $10^7\Omega$ to $10^9\Omega$.

In addition, the secondary-transfer rear roller 53 may be formed of any type of a foamed rubber having a degree of hardness of from 20 to 50, or a rubber having a degree of hardness of from 30 to 60. With this structure, the white dots that form easily when the contact pressure between the intermediate transfer belt 51 and the secondary transfer rear roller 53 is increased can be prevented from occurring.

The nip forming roller 56 is formed by a metal bar (core metal) on which a resistive layer and a surface layer are laminated. The metal bar is made of stainless steel, aluminum, or the like. The resistive layer is formed of semi-conductive rubber. In this embodiment, the external diameter of the nip forming roller 56 is approximately 20 mm. The diameter of the metal bar is approximately 16 mm stainless steel. The resistive layer is formed of a friction rubber NBR/ECO having a degree of hardness from 40 to 60. The surface layer is formed of fluoro urethane elastomer having a thickness within 8 μm to 24 μm. As for the reason, the surface layer is manufactured by coating with the roller, as a result, when the thickness of the surface layer is less than 8 μm, the influence of the resistive unevenness caused by coating unevenness is great, which is not preferable because leakage may occur in an area in which the resistance is low. In addition, wrinkles may occur in the surface of the roller, which causes cracks in the surface layer.

By contrast, when the thickness of the surface layer is thicker than 24 μm, the resistance thereof is increased. Then, when the volume resistivity is high, the voltage when the constant current is applied to the metal bar of the secondary transfer rear roller 53 may be increased. The voltage exceeds a voltage variable range in the secondary transfer power supply (constant-current power source) 200, and therefore, the current becomes less than the target current. Alternatively, when the voltage variable range is sufficiently high, a voltage in passage from the constant current power supply 200 to the metal bar of the secondary transfer rear roller 52 and the voltage in the metal bar of the secondary transfer rear roller 52 become high, which causes current leakage. In addition, when the thickness of the nip forming roller 56 is thicker than 24 μm, the nip forming roller 56 becomes harder, and the adhesion to the recording media (sheet) and the intermediate transfer belt 51 deteriorates.

In the present embodiment, the surface resistance of the nip forming roller 56 is over $10^{6.5}\Omega$ and the volume resistivity of the surface layer of the nip forming roller 56 is over $10^{10}$ Ωcm, preferably, over $10^{12}$ Ωcm.

The electronic potential sensor 58 is provided inside the loop of the intermediate transfer belt 51, facing the loop of the intermediate transfer belt 51 around which the driving roller 52 is wound, and facing 4 mm gap. Then, when the toner image transferred onto the intermediate transfer belt 51 enters the portion facing the electronic potential sensor 58, the electronic potential sensor 58 measures the electronic potential of the surface thereof. Herein, EFS-22D, manufacture by TDK company, is used as the electronic potential sensor 58.

On the right side of the secondary transfer nip formed between the secondary-transfer rear roller 53 and the intermediate transfer belt 51, the fixing device 90 is disposed. The fixing device 90 includes a fixing roller 91 and a pressing roller 92. The fixing roller 91 includes a heat source such as a halogen lamp inside thereof. While rotating, the pressing roller 92 presses against the fixing roller 91, thereby forming a heated area called a fixing nip therebetween.

The recording medium P bearing an unfixed toner image on the surface thereof is conveyed to the fixing device 90 and interposed in a fixing nip between the fixing roller 91 and the pressing roller 92 in the fixing device 90. Under heat and pressure in the fixing nip, the toner adhered to the toner image is softened and fixed to the recording medium P. Subsequently, the recording medium P is discharged outside the image forming apparatus 1000 from the fixing device 90 along a sheet passage after fixing.

(Secondary Transfer Bias Power Supply)

The image forming apparatus 1000 includes a secondary transfer bias power supply 200. The secondary transfer bias power supply 200 includes a direct current (DC) voltage source 201 to output a direct current voltage (DC voltage) and a superimposed voltage source 202 (AC+DC voltage source) to output a superimposed transfer bias voltage in which an alternating current (AC) voltage is superimposed on a direct current voltage. As a secondary transfer bias, the secondary transfer bias power supply 200 outputs a direct current transfer bias (hereinafter "DC bias") constituted by the direct current voltage and the superimposed transfer bias (hereinafter "superimposed bias") in which the AC voltage is superimposed on the DC voltage. The secondary transfer roller 56 and the secondary transfer rear roller 53 function as secondary transfer members.

Figure 3A:
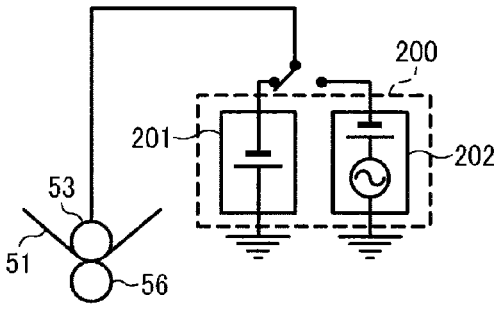
FIGS. 3A and 3B are schematic diagram illustrating secondary transfer members and a secondary transfer bias power supply.
Figure 3B:
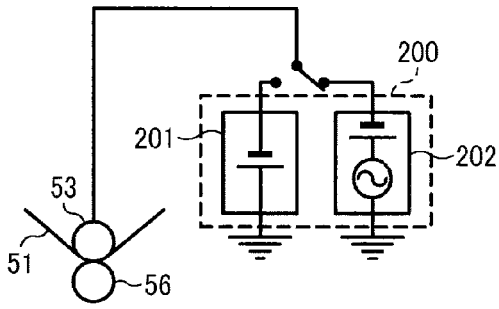

FIGS. 3A and 3B are schematic diagrams illustrating the secondary transfer members 53 and 56 and the secondary transfer bias power supply 200. In FIGS. 3A and 3B, the secondary transfer bias power supply 200 switches between the DC bias and the superimposed bias for output to the secondary transfer members 53 and 56.

Figure 5:
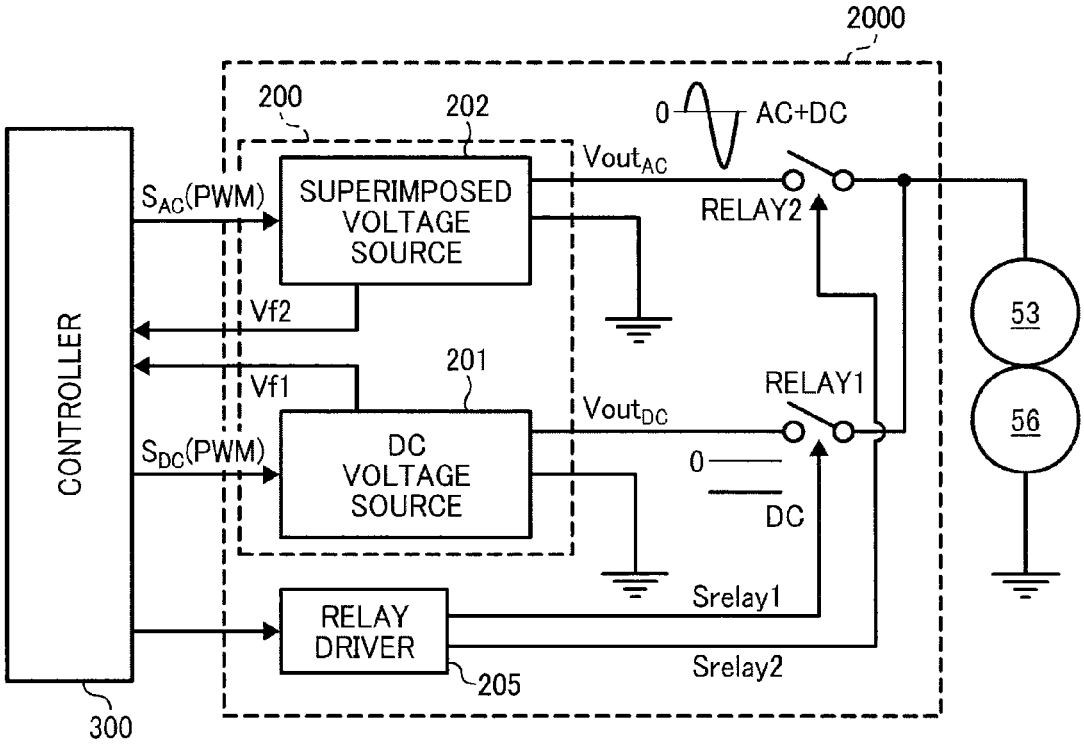
FIG. 5 is a block diagram illustrating a configuration of the secondary transfer bias power supply including a direct current voltage source and the superimposed voltage source.

In FIGS. 3A and 3B, the secondary transfer bias power supply 200 is constituted by the DC voltage source 201 and the superimposed voltage source 202. In a state shown in FIG. 3A, the DC bias from the DC voltage source 201 is applied to the secondary transfer member 53. In a state shown in FIG. 3B, the superimposed bias from the superimposed voltage source 202 is applied to the secondary transfer member 53. FIGS. 3A and 3B conceptually illustrate the switching between the DC voltage source 201 and the superimposed voltage source 202, controlled by a switch 207. Alternatively, the switching therebetween can be performed by using two relay switches as shown in FIG. 5, which is described further detail later.

Figure 4:
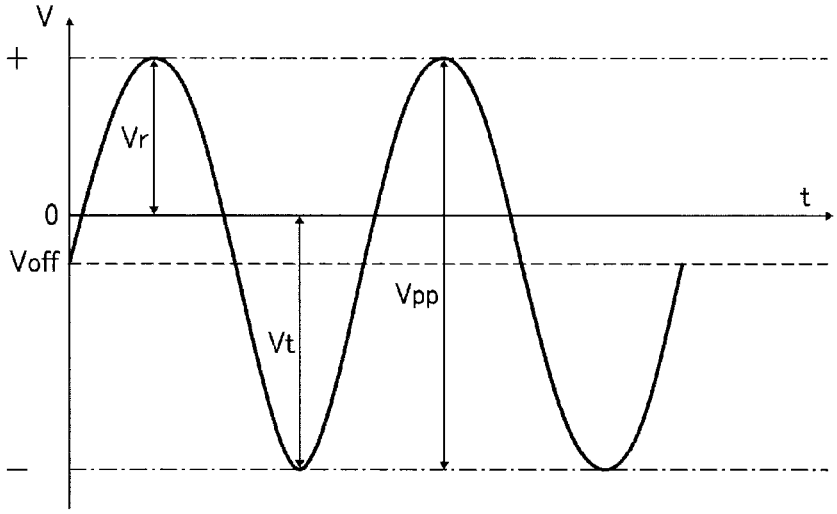
FIG. 4 is a waveform diagram illustrating a waveform in a superimposed bias output from a superimposed voltage source in the secondary transfer bias power supply shown in FIGS. 3A and 3B.

FIG. 4 is a waveform diagram illustrating a waveform in the superimposed bias output from the superimposed voltage source 202. In FIG. 4, an offset voltage Voff is a value of a direct current (DC) component of the superimposed bias. A peak-to-peak voltage Vpp is a peak-to-peak voltage of an alternating current (AC) component of the superimposed bias. The superimposed bias is a value in which the peak-to-peak voltage Vpp is superimposed on the offset voltage Voff. In FIG. 4, the superimposed bias is a sine waveform, having plus-side peak and minus-side peak. The minus-side peak is indicated by a value Vt, corresponding to a position at which the toner is moved from the belt side to the recording medium, in the secondary transfer nip. The plus-side peak is represented by a value Vr, corresponding to a position direction in which the toner is returned to the belt side (plus side).

By applying the superimposed bias including the alternating current (AC) and setting the offset voltage Voff (applied time-averaged value) to the same polarity as the toner, the toner is reciprocally moved and is relatively moved from the belt side to the recording medium. Thus, the toner is transferred on the recording medium. It is to be noted that although in the present embodiment a sine waveform is used as the alternating voltage in the present embodiment, alternatively a rectangular wave may be used as the alternating current voltage.

In the present disclosure, the transfer mode is switched depending on the asperity of the recording medium. More specifically, when a rough sheet having large asperity (e.g., wavy Japanese paper, or an embossed sheet) is used as the recording medium, the toner image is transferred in the superimposed transfer mode. By applying the superimposed bias, while the toner is reciprocally moved and relatively moved from the belt side to the recording medium side to transfer the toner onto the recording medium. With this configuration, transfer performance to concave portions of the rough sheet can be improved, and entire transfer efficiency is improved, thereby preventing the formation of abnormal images, such as images with white spots in which the toner is not covered with the concave portion. By contrast, when a sheet having small asperity (e.g., normal transfer sheet) is used as the recording medium, sufficient transfer performance can be attained by applying secondary transfer bias consisting only of the direct current (DC) voltage.

In the present embodiment, the transfer mode can be switched between a direct current transfer mode during which the direct current transfer bias is applied to transfer the toner image and a superimposed transfer mode during which the superimposed transfer bias is applied to transfer the toner image while the direct current voltage source 201 and the superimposed voltage source 202 are off.

Therefore, the transfer mode is switched between the direct current transfer mode and the superimposed transfer mode depending on asperity of the recording medium (types of recording medium). Accordingly, the preferable image transfer can be performed for both recording medium having small asperity and the recording medium having large asperity.

The transfer mode may be switched automatically, by setting the sheet type. Alternatively, the user may designate the transfer mode. These setting may be set from a control panel on the image forming apparatus 1000.

FIG. 5 is a block diagram illustrating a configuration of a secondary bias applicator 2000. In this configuration, using two relay switches RELAY1 and RELAY2, the voltage sources 201 and 202 to apply bias are switched. As illustrated in FIG. 5, the DC voltage source 201 applies the DC bias to the secondary transfer rear roller 53 via a DC relay switch RELAY1, serving as a first relay. The superimposed voltage source 202 applies the superimposed bias to the secondary transfer rear roller 53 via a superimposed relay switch RELAY2, serving as a second relay. In other word, the secondary bias applicator 2000 includes the first relay RELAY1 through which the direct current transfer bias from which the direct current voltage source 201 is output and the second relay RELAY2 through which the superimposed current transfer bias from which the superimposed voltage source 202 is output.

By controlling connection and disconnection of the relay switches RELAY1 and RELAY2 by a controller 300 via a relay driver 205, the DC bias are the superimposed bias are switched as the secondary transfer bias. A feedback voltage Vf1 from the DC voltage source 201 and a feedback voltage Vf2 from the superimposed voltage source 202 are input to the controller 300.

In this embodiment, in a period during which the DC bias is applied as the secondary transfer bias, based on the feedback voltage Vf1 from the DC voltage source 201, resistance of the secondary transfer member side (containing resistance values of the intermediate transfer belt 51 and the recording medium) is calculated, and a value of the transfer bias is determined and controlled. In this configuration, the direct current voltage source 201 is subjected to constant current control.

Figure 6:
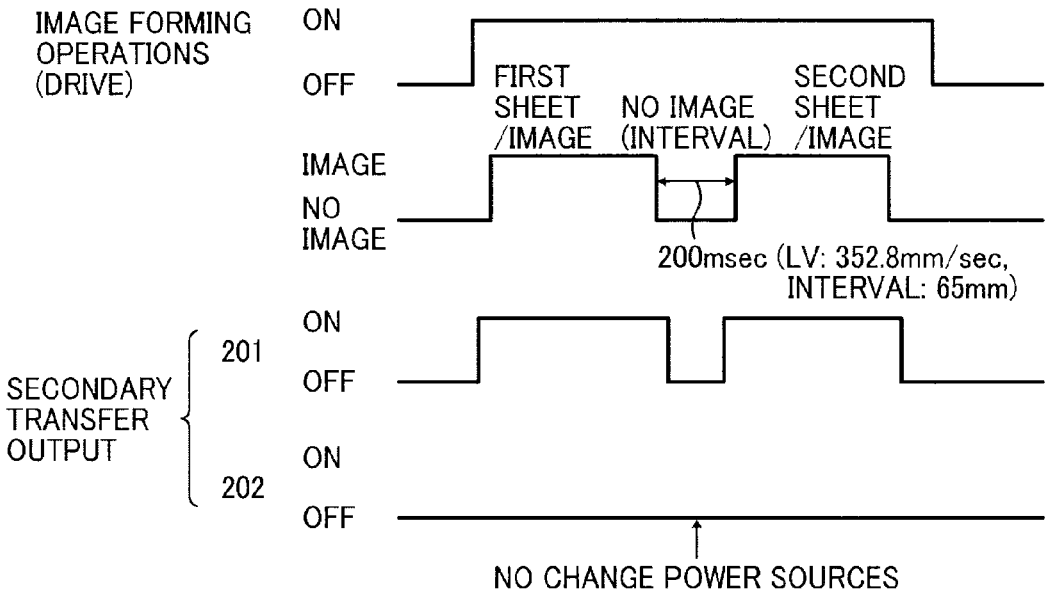
FIG. 6 is a timing chart illustrating control of the voltage sources during a direct current transfer mode.

FIG. 6 is a timing chart illustrating control of the voltage sources 201 and 202 during the direct current (DC) transfer mode. In other word, FIG. 6 illustrates a timing chart of the control of the power supply 200 when the transfer mode is not changed. As illustrated in FIG. 6, the DC voltage source 201 is turned on timed to coincide with the arrival of the image to the secondary transport members 53 and 56 (coincide with the sheet is transported into a secondary transfer nip between the secondary transfer roller 56 and the secondary transfer rear roller 53), the toner image on the intermediate transfer belt 51 is transferred onto the recording medium. When the recoding medium to be printed (former sheet) is identical types the printing recording medium (latter sheet), the voltage sources 201 and 202 are not switched. Herein, the superimposed voltage source 202 keeps off state.

Figure 7:
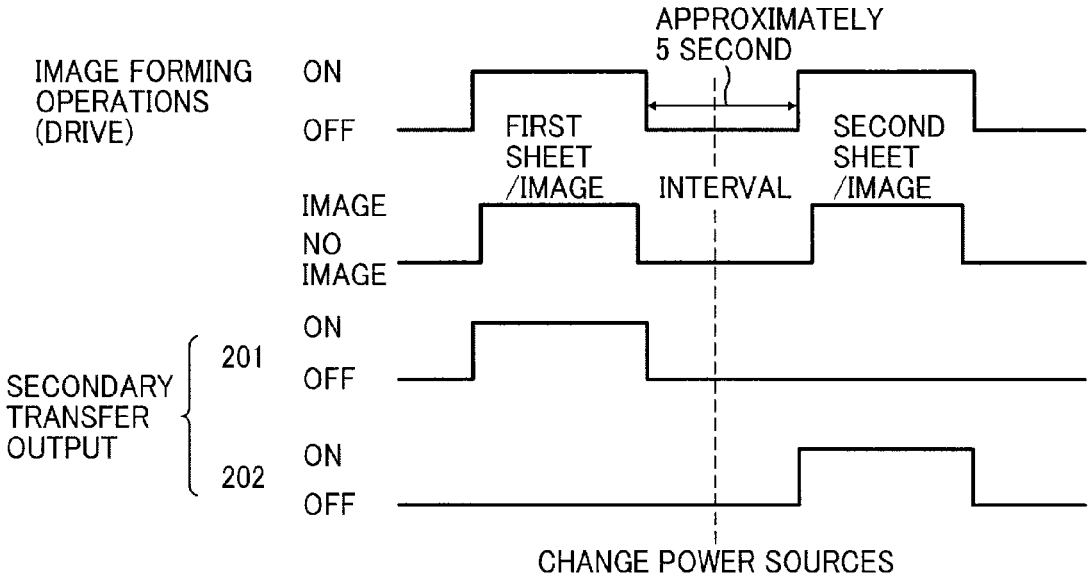
FIG. 7 is a timing chart illustrating control of switching the voltage sources using a switching method in which a transfer mode is switched from a DC transfer mode to a superimposed transfer mode while the image forming units stop image formation.

When the type of recording media through which the secondary transfer nip is changed, for example, when the recording medium is changed from the normal sheet having small asperity to the wavy leather-like paper having large asperity, the voltage source used in the secondary transfer bias power supply 200 is switched from the DC voltage source 201 to the superimposed voltage source 202, and the transfer mode is switched from the DC transfer mode to the superimposed (AC+DC) transfer mode, as illustrated in FIG. 7.

By contrast, when the type of recording medium is changed from the wavy leather-like paper having large asperity to the normal sheet having small asperity, the voltage source used in the secondary transfer power supply 200 is switched from the superimposed voltage source 202 to the DC voltage source 201, and the transfer mode is switched from the superimposed transfer mode (AC+DC transfer mode) to the DC transfer mode. This switching can be formed during printing, for example, the transfer mode is changed in a time interval between a first sheet (former sheet) and a second sheet (latter sheet), which is described below.

Figure 8:
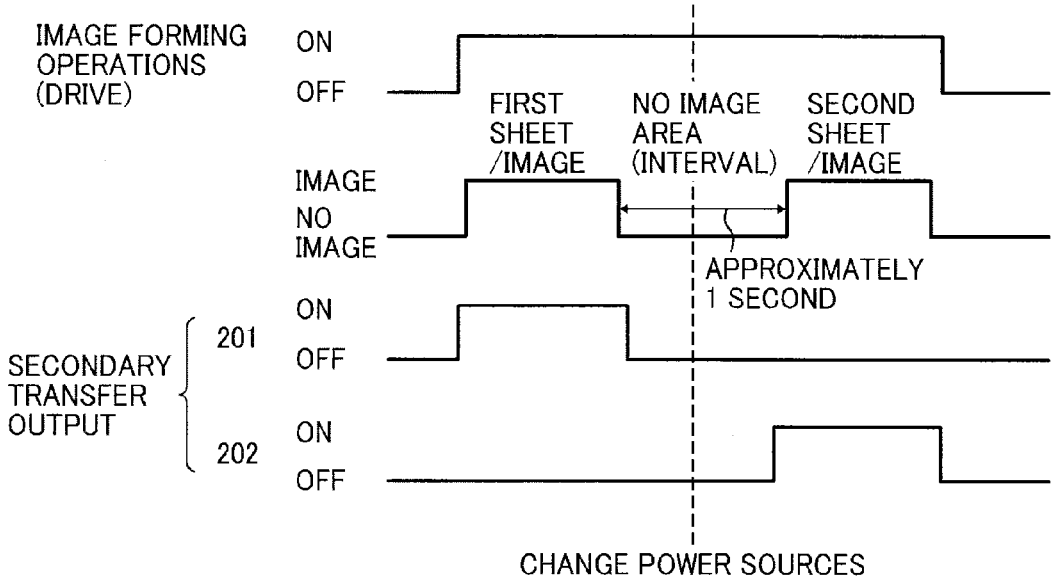
FIG. 8 is a timing chart illustrating control of switching the voltages sources using a switching method in which the transfer mode is switched in an interval between successive image formations.

More specifically, the controller 300 switches the transfer mode while the image forming unit 1 stop image formation (as shown in FIG. 7) or in an interval between successive image formation (see FIG. 8). That is, the controller 300 switches between the voltage sources 201 and 202 after driving the image forming units 1Y, 1M, 1C, and 1K is stopped. In addition, the controller switches after the output of the secondary transfer members 56 and 52 is turned off in a state in which the image forming operation is continued (keeps driving in the image forming unit 1Y, 1M, 1C, and 1K). FIGS. 7 and 8 illustrate timing charts of the control of the power supply when the transfer mode is switched from the DC transfer mode to the DC-AC transfer mode.

FIG. 7 is a timing chart illustrating control of switching the voltage sources 201 and 202 using a switching method in which the transfer mode is switched from the DC transfer mode to the superimposed transfer mode while the image forming unit 1Y, 1M, 1C, and 1K stop image formation. In the method shown in FIG. 7, it requires approximately 5 seconds for switching transfer mode.

FIG. 8 is a timing chart illustrating control of switching voltage sources 201 and 202 using a switching method in which the transfer mode is switched in an interval a between the images (between recording media) after the output of the secondary transfer members 53 and 56 is turned off in a state in which the image forming operation is continued (keeps driving in the image forming unit). In the method shown in FIG. 8, it requires approximately 1 seconds for switching transfer mode in the interval between the images (during an interval from when the former sheet is left to when the latter sheet is arrived).

In addition, the interval between successive image forming operations while the controller 300 switches the transfer mode (see FIG. 8) is longer than the interval between successive image forming operations when the controller 300 does not switch the transfer mode (see FIG. 6). Since the interval between the images when the transfer mode is changed (see FIG. 8) is set longer than the interval the images when the transfer mode is not changed (see FIG. 6), the mode switching is not adversely effect to the forming image and transporting image. The image timing indicates the timing when the image is moved to the secondary transfer members 56 and 53, corresponding to the interval between the images (interval between the former sheet and the latter sheet).

In the method shown in FIG. 7, a control of the stop driving is easy, although the interval between the images (interval between recording media) is longer. In addition, the present control can easily correspond to change the linear velocity of the secondary transfer members in accordance with the type of recording media. By contrast, in the method shown in FIG. 8, the interval between the recording media becomes slightly longer than the case shown in FIG. 6, to be true, but the long period is just approximately 1 second. Thus, the influence of productivity can be minimized.

Although FIGS. 7 and 8 illustrate the cases in which the transfer mode is changed from the DC bias (DC transfer mode) to the superimposed bias (superimposed transfer mode), the transfer bias may be changed in a opposite directions, that is, the transfer mode may be changed from the superimposed transfer mode to the DC transfer mode by switching from the superimposed voltage source 202 to the DC voltage source 201. In this case, the DC voltage source 201 is changed from on to off, the superimposed voltage source 202 is off to on.

As described above, in the image forming apparatus 1000, the controller 300 can changes the transfer mode in the secondary transfer bias applicator 2000 between the DC bias transfer mode during which the DC bias is applied and the superimposed transfer mode during which the superimposed bias is applied. While the transfer mode is switched, the output to the secondary transfer members 53 and 56 from the secondary transfer bias power source 200 is off. Accordingly, a reverse current that the current flows from the DC voltage source 201 to the superimposed voltage source 202, or from the superimposed voltage source 202 to the DC voltage source 201, can be prevented, which prevents malfunction and the breakage of the power supply 200.

In addition, since generation of the reverse current flowing to the voltage sources 201 and 202 can be prevented, increasing the durability of the power source is not necessary in case of the reverse current, which prevents the increase in the cost of the secondary transfer power supply 200.

Herein, operation of rising and falling of a high-voltage from the voltage sources 201 and 202 is described below with reference to FIG. 9. The configuration of the superimposed voltage source 202 in which the AC voltage is superimposed on a large output value of the DC voltage cannot help delaying in the rising time and the falling time of the high-voltage output.

Figure 9:
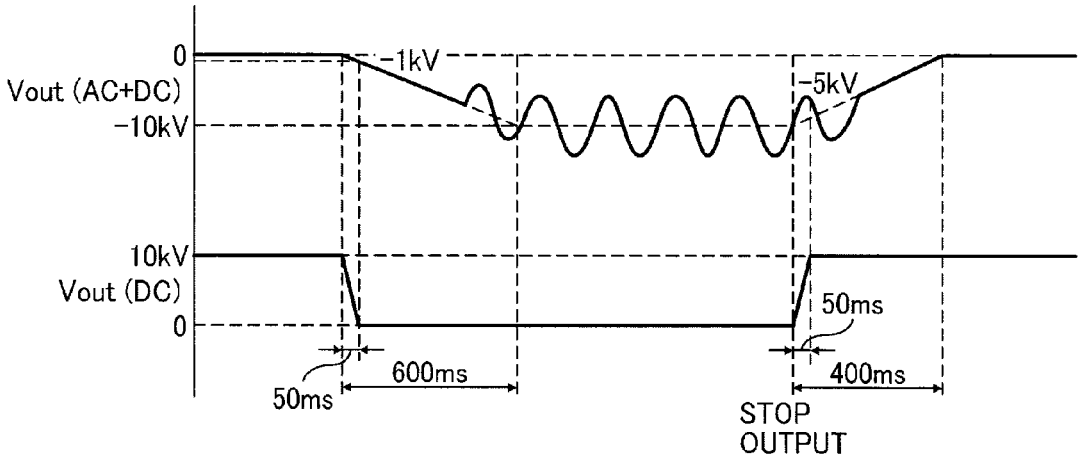
FIG. 9 is a schematic diagram illustrating a rising and falling of output voltages from the direct current voltage source and the superimposed voltage source.

As one example illustrated in FIG. 9, the rising time and the falling time is 50 ms in the DC voltage source 201, and the rising time of the superimposed voltage source (AC-DC voltage source) 202 is 600 ms, the falling time thereof is 400 ms. Accordingly, when the power sources are switched (transfer mode is changed), it is necessary to consider the rising time and the falling time when the voltage sources 201 and 202 are turned on and off. Therefore, in the present embodiment, the controller 300 stores a first standby time period for switching the transfer mode from the direct current transfer mode to the superimposed transfer mode and a second standby time period for switching the transfer mode from the superimposed transfer mode to the direct current transfer mode. Thus, the reverse current flowing to the other power source can be reliably prevented, which is preferable.

Figure 10:
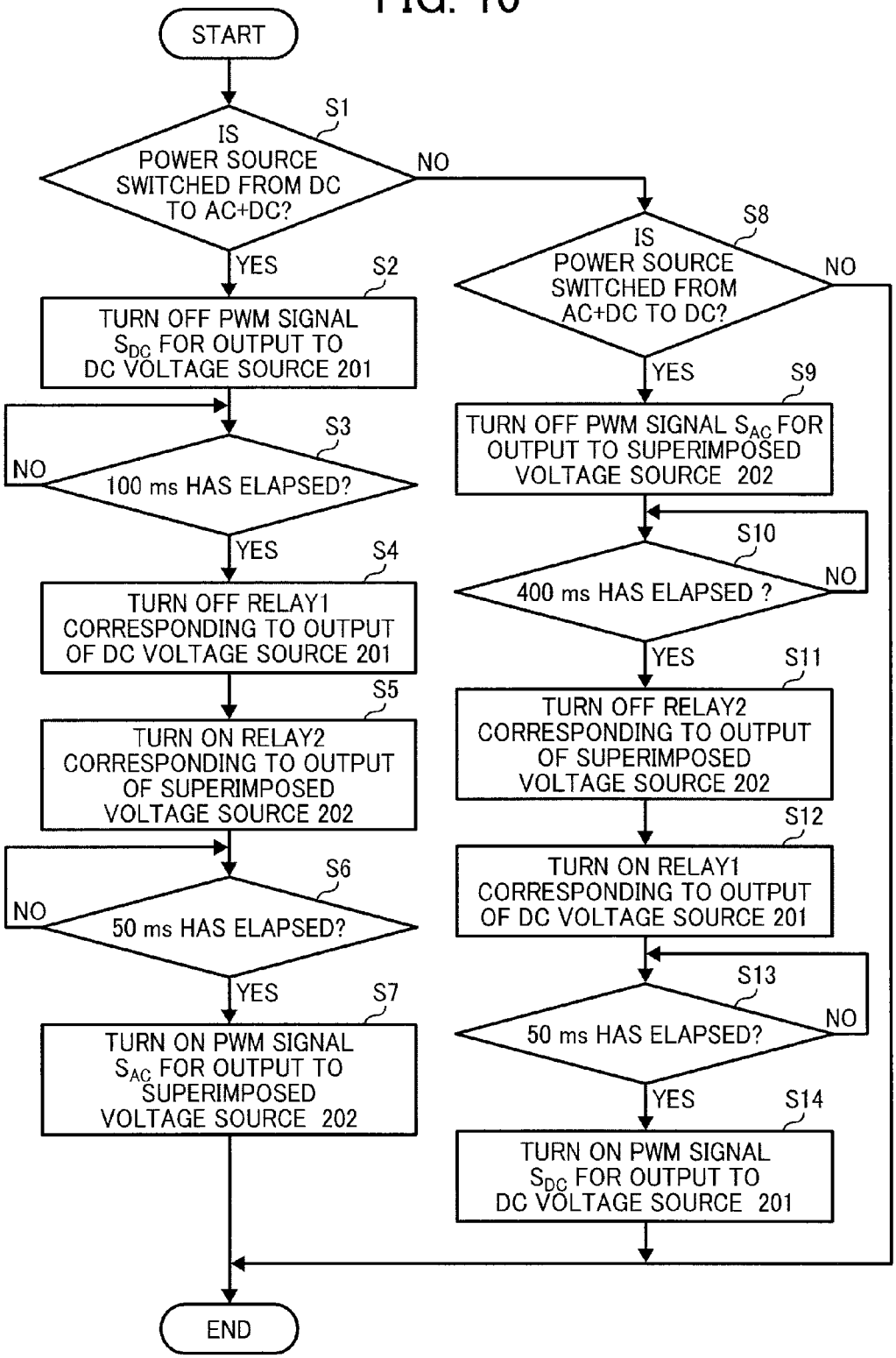
FIG. 10 is a flowchart illustrating a switching control process to switch between voltage sources, considering the rising time and the falling time of the output voltages of the voltage sources.

FIG. 10 is a flowchart illustrating a switching control process to switch between voltage sources 201 and 202, considering the rising time and the falling time of high-voltage output from the voltage sources 201 and 202.

In this flow chart, at step S1, the controller 300 checks whether or not the DC voltage source 201 is switched to the superimposed voltage source 202. When the DC voltage source 201 is switched to the superimposed voltage source 202 (Yes at S1), the process proceeds to step S2, and the other case (No at S1), the process proceeds to step S8. At the step S8, the controller 300 checks whether or not the superimposed voltage source 202 is switched to the DC voltage source 201. When the superimposed voltage source 202 is switched to the DC voltage source 201 (Yes at S8), the process proceeds to step S9. In other cases, that is, the voltage sources 201 and 202 are not changed, the switching control process is finished.

At the step S2, a PWM signal (direct-current (DC) control signal) Sdc output to the DC voltage source 201 is turned off. At step S9, a PWM signal (superimposed control signal) Sac output to the superimposed voltage source 202 is turned off. At step S3, the secondary transfer bias applicator 2000 waits for 100 ms (first standby time period), considering the falling time (about 50 ms shown in FIG. 9) of the DC voltage source 201. At step S10, the secondary transfer bias applicator 2000 waits 400 ms (second standby time period) corresponding to the falling time of the superimposed voltage source 202.

After the respective standby time periods have elapsed, the process proceeds from step S3 to S4 and S10 to S11. Then, at steps S4 and S5, the first relay RELAY1 is turned off, and the second relay RELAY2 is turned on (see FIG. 5). Thus, the output of the secondary transfer bias power supply 200 is switched from the DC bias to the superimposed bias. While, at steps S11 and S12, the AC relay switch RELAY2 is turned off and the DC relay switch RELAY1 is turned on. Thus, the output of the secondary transfer bias power source 200 is switched from the superimposed bias (superimposed transfer mode) to the DC bias (DC transfer mode).

Then, the process proceeds from steps S6 to S7 and S13 to S14, the secondary transfer bias applicator 2000 waits 50 mS corresponding to a relay driving time.

In the process shown in FIG. 10, at steps S3 and S10, the standby time periods are set corresponding to transfer mode switching times from the DC transfer mode to the superimposed transfer mode or the superimposed transfer mode to the DC transfer mode, stated another way, corresponding to switching from the voltage sources 201 to 202 or 202 to 201 in the steps S1 and S8.

In the flow from steps S1 to S4, since the DC voltage source 201 is switched to the superimposed voltage source 202, the (first) standby time period is set to 100 ms considering the falling time of the DC voltage source 201. While, in the flow from steps S8 to S11, since the superimposed voltage source 202 is switched to the DC voltage source 201, the (second) standby time period is set to 400 ms considering the falling time of the superimposed voltage source 202.

As it is clear in steps S1 through S7 shown in FIG. 10, when the transfer mode is switched from the direct current transfer mode to the superimposed transfer mode, the controller 300 switches the DC control signal Sdc (PWM) for output to the DC voltage source 201 to cause the DC voltage source 201 to stop driving, the first standby time period (100 ms) has elapsed, and the first relay RELAY1 is turned off and the second relay RELAY2 is turned on. Then, the controller 300 switches the superimposed control signal Sac(PWM) for output to the superimposed power source 202 to cause the superimposed power source 202 to start driving.

In addition, as it is clear in steps S8 through S14 shown in FIG. 10, when the transfer mode is switched from the superimposed transfer mode to the direct current transfer mode, the controller 300 switches the superimposed control signal Sac (PWM) for output to the superimposed voltage source 202 to cause the superimposed voltage source 202 to stop driving, the second standby time period (400 ms) has elapsed, and the second relay RELAY2 is turned off and the first relay RELAY1 is turned on. Then, the controller 300 switches the DC control signal Sdc (PWM) for output to the DC voltage source 201 to cause the DC voltage source 201 to start driving.

Then, after respective standby time periods have past, the relay switches are controlled based on the direction of the switching of the transfer mode. That is, when the transfer mode is changed, the first relay RELAY1 and the second relay RELAY2 are operated after the corresponding standby time periods have elapsed. Therefore, the other current does not snake into the other power source before the output is decreased to zero.

More specifically, when the transfer mode is changed from the DC transfer mode to the superimposed transfer mode, the second relay switch RELAY2 is tuned off after 100 ms has elapsed from turning off the PWM signal Sdc to the DC voltage source 201, considering the falling time of the DC voltage source 201. Therefore, when the second relay switch RELAY2 is connected (turned on). Thus, the charge in the DC side (DC voltage source 201) is completely discharged. Thus, the current does not snake into the superimposed voltage source 202.

By contrast, when the transfer mode is changed from the superimposed transfer mode to the DC transfer mode, the DC relay switch RELAY1 is turned on after 400 ms has elapsed from turning off the PWM signal Sac to the superimposed voltage source 202 considering the falling time of the superimposed voltage source 202 Therefore, the second relay switch RELAY2 is connected (turned on), the charge in the superimposed side (superimposed voltage source 202) is completely discharged off when the first relay switch RELAY1 is connected. Thus, the current does not snake into the DC voltage source 201.

As described above, when the transfer mode (voltage sources) is changed, after the voltage source is turned off, the standby time period has set in accordance with the type of voltage sources, and the relay switches based on the changing direction. Thus, after the charge is completely discharged, the output of the secondary transfer bias power source 200 is switched. Thus, malfunction and broken power sources caused by the reverse current (snake current into the other power sources) can be reliably prevented.

When the transfer mode is switched from the superimposed transfer mode to the DC transfer mode, it requires longer time to raise the voltage in the superimposed voltage source 202, compared to the DC voltage source 201 (see FIG. 9). Accordingly, the second standby time period for switching the transfer state from the superimposed transfer mode (using superimposed voltage source 202) to the direct current transfer mode (using DC voltage source 201) is longer than the first standby time period for switching the transfer state (using DC voltage source 201) from the direct current transfer mode (using DC voltage source 201) to the superimposed transfer mode (using superimposed voltage source 202). Therefore, by setting sufficient long standby time period for switching when the transfer mode is changed from the superimposed transfer mode to the DC transfer mode, the reverse current can be reliably prevented.

In addition, in the configuration shown in FIG. 5, since switching the output of the voltage sources is controlled by using the relay switches RELAY1 and RELAY2, the reverse current is reliably prevented.

Further, after the PWM signals (DC control signal or superimposed control signal) Sdc (or Sac) to operate the output of the voltage sources 201 (or 202) are turned off (off signal is output), the respective standby time periods have elapsed. Then, the other PWM signal Sac (or Sdc) to operate the output of the voltage source 202 (or 201) is output (on signal to indicate the output on of the respective voltage sources 201 and 202) based on the direction of the transfer mode switching is output. With this control, the current reverse is reliably prevented.

It is to be noted that, although the configuration of the power supply 200 that includes the DC voltage source 201 to output the DC voltage and superimposed voltage source 202 to output the superimposed voltage in which the AC voltage is superimposed on the DC voltage (see FIG. 5) and switching control in this configuration (see FIG. 10) are described, the configuration of the secondary transfer bias applicator is not limited above, the bias applicator is adoptable only to switch the DC bias and the superimposed bias other than this configuration, and the switching control can be adopted in accordance with the corresponding configuration.

Figure 11:
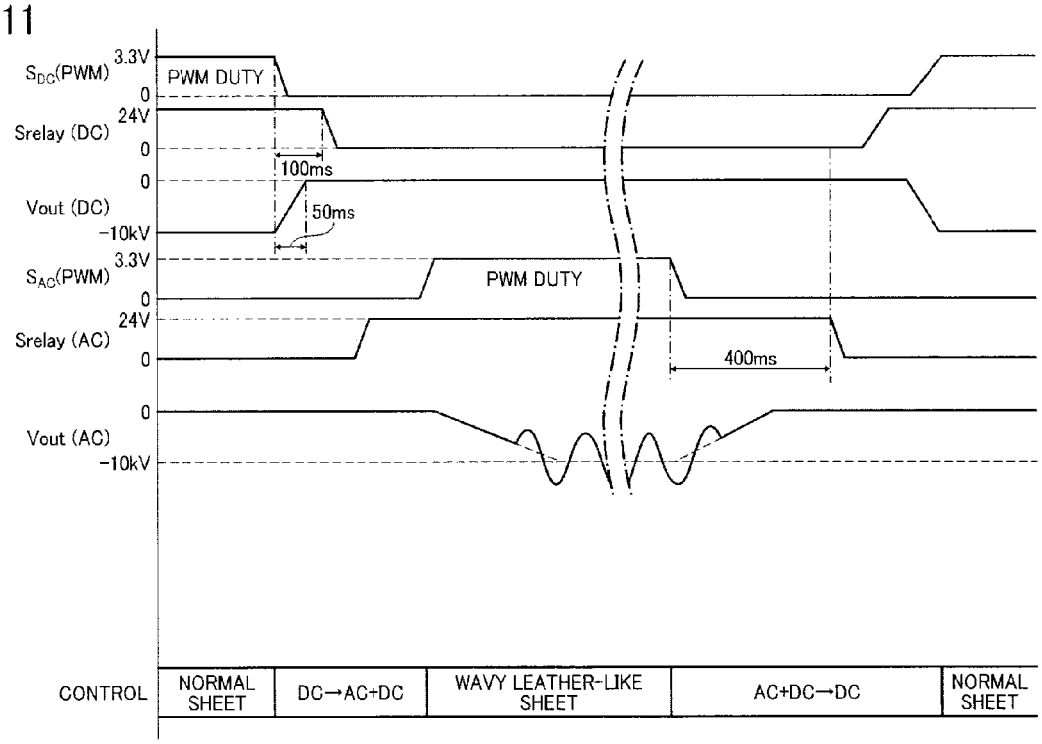
FIG. 11 is a timing chart illustrating control of the voltage sources when the transfer mode is switched in accordance with the change in the sheet type to pass through the secondary transfer members.

FIG. 11 is a timing chart illustrating control of the voltage sources 201 and 202 when the transfer mode in the secondary transfer members 53 and 56 is switched in accordance with the change in the sheet type to pass through the secondary transfer members 53 and 56. In the control shown in FIG. 11, the recording medium is changed from a normal sheet having small asperity to a wavy leather-like paper having large asperity, and then is changed from the leaser-like paper to the normal sheet.

Output signals from top to bottom illustrated in the graph FIG. 11 is described as below. Sdc(PWM) represents the direct-current control signal to control the high-voltage output from the DC voltage source 201 using pulse-width modulation (PWM), Srelay(DC) represents a control signal to drive the first relay switch RELAY1 that switches on/off of the output voltage from the DC voltage source 201, and Vout(DC) represents a value of the DC voltage output from the DC voltage source 201. Sac(PWM) represents the superimposed control signal to control high voltage output from the superimposed voltage source 202 using PWM control, Srelay(AC) represents a control signal to drive the second relay switch RELAY2 that switches on/off of the output voltage from the superimposed voltage source 202, and Vout(AC) represents a value of the superimposed voltage output from the superimposed voltage source 202. Herein, the control signal Srelay (DC) is turned on when the output voltage Vout(DC) is 24 volts of high voltage and is turned off when the output voltage Vout(DC) is zero volts. The control signal Srelay(AC) is turned on when the output voltage Vout(AC) is 24 volts of high AC voltage and is turned off when the output voltage Vout(AC) is zero volts.

The DC voltage source 201 and the superimposed voltage source 202 control duty-period of pulse width modulation (PWM) from the controller 300.

Herein, when the secondary transfer is performed on the normal sheet, the DC transfer output signal Sdc is high, the high-voltage DC relay switch RELAY1 is on, and the DC voltage source 201 outputs a high-voltage DC at −10 kV. At this time, the AC transfer high-voltage output signal Sac is off, the high-voltage AC relay switch RELAY2 is off and the output from the superimposed voltage source 202 is zero.

As the passed recording medium is changed from the normal sheet to the wavy leather-like sheet, the DC transfer output signal Sdc(PWM) is changed from high to low, and as a result, the output signal Vout from the DC voltage source 201 changes from −10 kV of high voltage to zero V in 50 mS (mili seconds).

The high-voltage DC relay switch RELAY1 is turned off after 100 ms has elapsed from switching high to low of the DC transfer output signal Sdc(PWM). The actual driving times of the relay switches RELAY1 and RELAY2 are only 30 ms to 40 ms in the present embodiment.

By contrast, the high voltage AC relay switch RELAY2 is turned on after the high-voltage DC relay switch RELAY1 is turned off. Subsequently, the AC transfer output signal Sac is turned on. As the AC transfer output signal Sac is turned on, the superimposed voltage source 202 starts to drive and applies the superimposed output (high-voltage AC) at −10 kV to the secondary transfer members 53 and 56. As described above, the rising time of the superimposed voltage source (AC-DC voltage source) 202 is approximately 600 ms.

Then, the passed recording medium is changed from the wavy leather-like sheet to the normal sheet, the AC transfer high-voltage output signal Sac is turned off. Accordingly, the AC high-voltage Vout(AC) from the superimposed voltage source 202 falls to zero. The high-voltage AC relay switch RELAY2 is turned off after a time needed to fall the AC high-voltage Vout(AC) (400 ms) has elapsed. Then, after the high-voltage AC relay switch RELAY2 is turned off, the high-voltage DC relay switch RELAY2 is turned on. As a result, the DC transfer high-voltage output signal is changed from low to high, and the DC voltage source 201 outputs the DC high-voltage Vout(DC).

As is clear in FIG. 11, the second standby time period for switching the transfer state from the superimposed transfer mode (using superimposed voltage source 202) to the direct current transfer mode (using DC voltage source 201) is longer than the first standby time period for switching the transfer state (using DC voltage source 201) from the direct current transfer mode (using DC voltage source 201) to the superimposed transfer mode (using superimposed voltage source 202).

(Variation)

As a variation of the power supply 200, the power supply may include a DC voltage source and an alternating current (AC) voltage source. In this variation, a controller switches between a direct current transfer mode during which the direct current transfer bias is applied to transfer the toner image and an alternating current transfer mode during which the alternating transfer bias is applied to transfer the toner image while the direct current voltage source and the alternating current voltage source are off.

However, the superimposed transfer mode is preferable to the AC transfer mode in view of the transfer performance in the concave portion in the recording medium.

<Second Embodiment>

Figure 12:
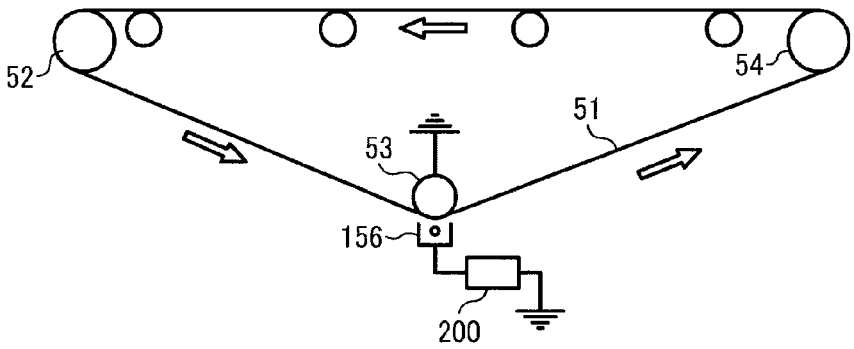
FIG. 12 is a schematic diagram illustrating vicinity of secondary transfer members according to a second embodiment.

Although the transfer member is not limited to make a nip, a non-contact transfer method using charger can be adopted. FIG. 12 is a schematic diagram illustrating a secondary transfer member according to a second embodiment. As illustrated in FIG. 12, in the second embodiment, a transfer charger 156 as a non-contact type transfer member faces the secondary transfer rear roller 53 is disposed outside loop of the intermediate transfer belt 51. The secondary transfer bias power supply 200 applies the DC bias and the superimposed bias to the transfer charger 156 while switching between the DC bias and the superimposed bias. As for the secondary transfer bias power source, the secondary transfer bias power supply 200 according to the first embodiment can be adopted.

It is to be noted that, in the second embodiment, the polarity of the DC component of the transfer bias applied to the transfer charger 156 is opposite to the polarity of the toner charging polarity. The transfer bias is transferred on the sheet passes between the transfer rear roller 53 and the transfer charger 156 via the intermediate transfer belt 51 by sucking.

In the second embodiment, when the transfer mode in the secondary transfer member is changed, similarly to the first embodiment, the transfer mode is switched in a state in which the outputs of the DC voltage source 201 and the superimposed voltage source 202 are off. As a result, the reverse current flowing from the DC voltage source 201 to the AC power source 202 or from the superimposed voltage source 202 to the DC voltage source 201 can be prevented, which prevents the breakout of the power sources.

In addition, since the reverse current flowing to the power sources can be prevented, it is not necessary to improve the durability of the power source in case of the generation of the reverse current, which prevents an increase in the cost of the secondary transfer power sources.

Figure 13:
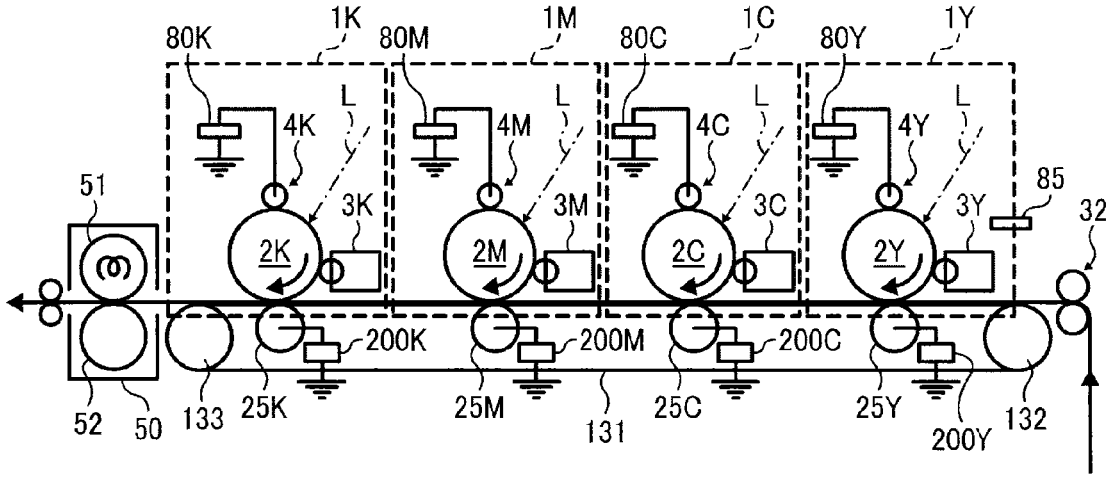
FIG. 13 is a schematic diagram illustrating a direct-transfer type image forming apparatus.

Herein, although the above-described secondary transfer member and control system is not limited to the intermediate-transfer type image forming apparatus, for example, as illustrated in FIG. 13, the above-described secondary transfer member and the control in the secondary transfer bias applicator can be adopted in a direct transfer type image forming apparatus in which the toner image on the photoreceptor is directly transferred on the recording medium. In this direct transfer type of color printer, the recording medium is sent to a transfer belt 131 by a feeding roller 32, respective color images are sequentially directly transferred from respective photoreceptor drums 2Y, 2M, 2C, and 2K onto the recording medium, and then the image are fixed by a fixing device 50.

As a power source to apply the transfer bias to the respective transfer members, the DC voltage source to apply the DC bias and the superimposed voltage source to apply the superimposed bias are provided. The secondary transfer bias can be applied while switching the DC bias and the superimposed bias. While the transfer bias is switched, as described above, the transfer mode is switched in a state in which the DC voltage source 201 and superimposed voltage source 202 are off. Therefore, the configuration shown in FIG. 13 can achieve effects similar to those of the image forming apparatus described above.

Figure 14:
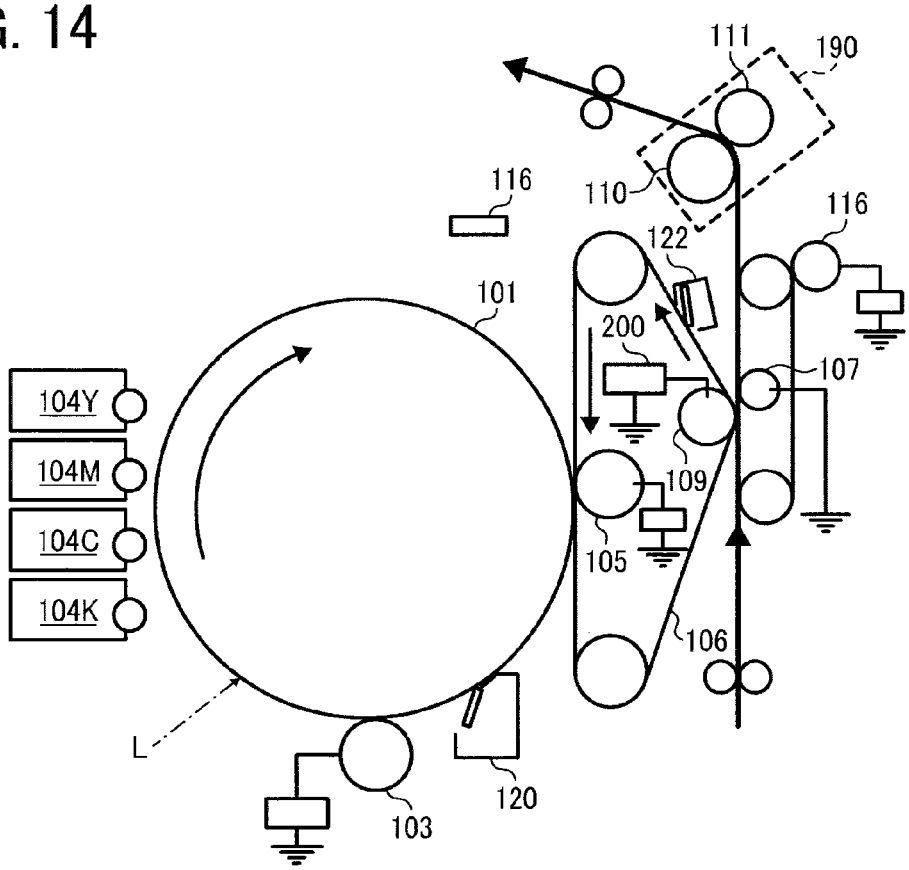
FIG. 14 is a schematic diagram illustrating a single drum photoconductor type image forming apparatus.

In addition, as illustrated in FIG. 14, the present disclosure can be adopted for so-called a single drum type color image forming apparatus. In this single drum type color image forming apparatus, a charging member 103, four development unit 104Y, 104C, 104M and 104K corresponding to respective yellow, cyan, magenta, and black. In this configuration, when the image is formed, initially, the charging member 103 uniformly charges the surfaces of the photoreceptor 101, then, the modulated laser beam L by Y image data is irradiated to the surface of the photoreceptors 101, which forms electrostatic latent image for yellow on the surface of the photoreceptor 101. Then, the development unit 104Y develops the electrostatic latent image for yellow. The Y toner image thus formed is primarily transferred on an intermediate transfer belt 106. After the residual toner after transfer on the surface of the photoreceptor 101 is removed by the cleaning device 120, the charging device 103 uniformly charges the surface of the photoreceptor 101. Subsequently, the modulated laser beam L by Y image data is irradiated to the surface of the photoreceptors 101, which forms electrostatic latent image for yellow on the surface of the photoreceptor 101. Subsequently, the development unit 104Y develops the electrostatic latent image for yellow The Y toner image thus formed is primarily transferred on the intermediate transfer belt 106. Then, for cyan and black, similarly the C and K toner images are primary transferred. Thus, the respective toner images on the intermediate transfer belt 106 are transferred on the recording medium transported to the secondary transfer nip.

The recording medium on which the toner image is transferred is transported to the fixing unit 190. The toner image on the recording medium is fixed on the recording medium with heat and pressure in the fixing unit 190. The recording medium after fixing is discharged to the discharge tray.

In this single-drum type color image forming apparatus, as a power source to apply the transfer bias to the respective transfer members, the DC power source to apply the DC bias and the superimposed power source to apply the superimposed bias are provided. The secondary transfer bias can be applied while switching the DC bias and the superimposed bias.

While the transfer bias is switched, as described above, the transfer mode is switched in a state in which the DC voltage source 201 and the superimposed voltage source 202 are off, the configuration shown in FIG. 14 of the third embodiment can achieve effects similar to those of the image forming apparatus 1000 described above.

Figure 15:
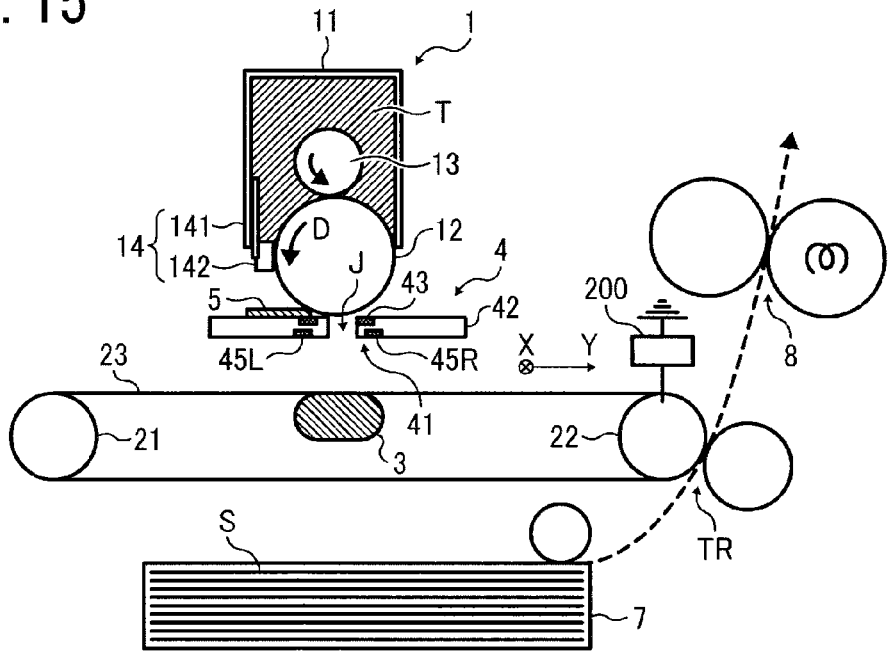
FIG. 15 is a schematic diagram illustrating a toner-jet type image forming apparatus.

FIG. 15 is a schematic diagram illustrating image forming unit in a toner-jet type image forming apparatus using intermediate transfer. In the image forming apparatus illustrated in FIG. 15, the image is formed by jetting toner onto an intermediate transfer belt 23, and the image is transferred on the recording medium in a transfer region. In this toner jetting type color image forming apparatus, as a power source to apply the transfer bias to the respective transfer members, the DC power source to apply the DC bias and the superimposed power source to apply the superimposed bias are provided. The secondary transfer bias can be applied while switching the DC bias and the superimposed bias.

While the transfer bias is switched, as described above, the transfer mode is switched in a state in which the DC voltage source 201 and the superimposed voltage source 202 are off, the configuration shown in FIG. 15 can achieve effects similar to those of the image forming apparatus described above.

It is to be noted that the configuration of the present specification is not limited to that shown in FIGS. 1 through 15. For example, the material and shape of the transfer member are not limited to the above-described embodiments, and various modifications and improvements in the material and shape of the developer regulator are possible without departing from the spirit and scope of the present invention. For example, the rear member may be formed by a belt.

In addition, the material and shape of the power supply are not limited to the above-described embodiments, and various modifications and improvements in the configuration of the power supply are possible without departing from the spirit and scope of the present invention. In addition, the configuration of the image forming apparatus and arrangement order of the image forming unit may be varied arbitrary.

Alternatively, although the image forming apparatus is not limited to the four color images, for example, the image forming apparatus of the present disclosure may be a monochrome image forming apparatus, or color image forming apparatus using full color using three-color or two-color image.

It is to be noted that the configuration of the present specification is not limited to that shown in FIG. 1. For example, the configuration of the present specification may be adapted to printers including an electrophotographic image forming device as well as other types of image forming apparatuses, such as copiers, facsimile machines, multifunction peripherals (MFP), and the like.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an image bearer to bear a toner image;

a transfer member to transfer the toner image;

a transfer bias applicator to apply a transfer bias to the transfer member, the transfer bias applicator comprising:

a direct current voltage source to apply a direct current transfer bias constituted by a direct current voltage to the transfer member; and a superimposed voltage source to apply a superimposed transfer bias in which an alternating current voltage is superimposed on a direct current voltage to the transfer member; and a controller that switches between a direct current transfer mode during which the direct current transfer bias is applied to transfer the toner image and a superimposed transfer mode during which the superimposed transfer bias is applied to transfer the toner image while the direct current voltage source and the superimposed voltage source are off.

2. The image forming apparatus according to claim 1, further comprising an image forming unit to form the toner image, wherein the controller switches the transfer mode while the image forming unit stops image formation.

3. The image forming apparatus according to claim 1, wherein the controller switches the transfer mode in an interval between successive image forming operations.

4. The image forming apparatus according to claim 3, wherein the interval between successive image forming operations when the controller switches the transfer mode is longer than the interval between successive image forming operations when the controller does not switch the transfer mode.

5. The image forming apparatus according to claim 1, wherein the controller stores a first standby time period for switching the transfer mode from the direct current transfer mode to the superimposed transfer mode and a second standby time period for switching the transfer mode from the superimposed transfer mode to the direct current transfer mode.

6. The image forming apparatus according to claim 5, wherein the second standby time period for switching the transfer mode from the superimposed transfer mode to the direct current transfer mode is longer than the first standby time period for switching the transfer mode from the direct current transfer mode to the superimposed transfer mode.

7. The image forming apparatus according to claim 5, further comprising:

a first relay through which the direct current transfer bias from which the direct current voltage source is output; and a second relay through which the superimposed transfer bias from which the superimposed voltage source is output, wherein, when the transfer mode is changed, the first relay and the second relay are operated after the respective first and second standby time periods have elapsed.

8. The image forming apparatus according to claim 7, wherein:

the controller generates a direct-current control signal for output to the direct current voltage source and a superimposed control signal for output to the superimposed voltage source; and when the transfer mode is switched from the direct current transfer mode to the superimposed transfer mode, the controller switches the direct-current control signal for output to the direct current voltage source to cause the direct current voltage source to stop driving, the first standby time period has elapsed, and then, the first relay is cut off and the second relay is turned on; subsequently, the controller switches the superimposed control signal for output to the superimposed voltage source to cause the superimposed voltage source to start driving.

9. The image forming apparatus according to claim 7, wherein:

the controller generates a direct-current control signal for output to the direct current voltage source and a superimposed control signal for output to the superimposed voltage source; and wherein, when the transfer mode is switched from the superimposed transfer mode to the direct current transfer mode, the controller switches the superimposed control signal for output to the direct current voltage source to cause the superimposed voltage source to stop driving, the second standby time period has elapsed, and then, the second relay is cut off and the first relay is turned on; subsequently, the controller switches the direct-current control signal for output to the direct current voltage source to cause the direct current voltage source to start driving.

10. The image forming apparatus according to claim 1, wherein the controller changes the transfer mode depending on asperity of recording medium having a surface on which the toner image is transferred.

11. The image forming apparatus according to claim 10, wherein the toner image is transferred in the superimposed transfer mode for a large-asperity recording medium.

12. The image forming apparatus according to claim 10, wherein the controller changes the transfer mode to the direct current transfer mode for a small-asperity recording medium to transfer the toner image.

13. The image forming apparatus according to claim 1, wherein the direct current voltage source is subjected to constant current control.

14. The image forming apparatus according to claim 1, further comprising:

an image forming unit to form the toner image; and a primary transfer member to transfer the toner image from the image forming unit, wherein the image bearer comprises an intermediate transfer member to bear the toner image that is transferred from the image forming unit, and the transfer member comprises a secondary transfer member to transfer the toner image on the intermediate transfer member to a recording medium.

15. The image forming apparatus according to claim 1, wherein the image bearer comprises a photoconductor to form and bear the toner image, and the transfer member transfers the toner image on the photoconductor to a recording medium.

16. The image forming apparatus according to claim 1, further comprising an image forming unit to form the toner image, wherein the controller switches the transfer mode while image formation of the image forming unit is continued.

17. An image forming apparatus, comprising:

an image bearer to bear a toner image;

a transferer that forms a transfer portion to transfer the toner image formed on the image bearer onto a sheet;

a DC voltage source that outputs a direct current transfer bias to the transfer portion via a first relay;

an AC voltage source that outputs a superimposed transfer bias in which an alternating current voltage is superimposed on a direct current voltage to the transfer portion via a second relay; and a controller that drives the first relay and the second relay while the DC voltage source and the AC voltage source are turned off.

18. The image forming apparatus according to claim 17, wherein the transferer is a transfer roller.

19. The image forming apparatus according to claim 17, wherein the image bearer is an intermediate transfer belt.

20. The image forming apparatus according to claim 17, wherein a first interval between a former sheet and a latter sheet when the controller drives the first relay arid the second relay is longer than a second interval between the former sheet and the latter sheet when the controller does not drive the first relay and the second relay.

21. The image forming apparatus according to claim 17, further comprising an image forming unit that forms the toner image, wherein the controller drives the first relay and the second relay while the image forming unit stops image formation.

22. An image forming apparatus, comprising:

an image bearer to bear a toner image;

a transferer that forms a transfer portion to transfer the toner image formed on the image bearer onto a sheet;

a power source that outputs a transfer bias to the transfer portion; and a controller that switches a transfer mode between a first mode during which the power source outputs a direct current transfer bias and a second mode during which the power source outputs a superimposed transfer bias in which an alternating current voltage is superimposed on a direct current voltage, wherein a first time interval between successive image forming operations when the controller switches the transfer mode from the second mode to the first mode is longer than a second time interval between successive image forming operations when the controller switches the transfer mode from the first mode to the second mode.

23. The image forming apparatus according to claim 22, wherein the power source includes:

a direct current voltage source that outputs a direct current transfer bias constituted by a direct current voltage to the transfer portion; and a superimposed voltage source that outputs a superimposed transfer bias in which an alternating current voltage is superimposed on a direct current voltage to the transfer portion.

24. The image forming apparatus according to claim 17, wherein one of the DC voltage source and the AC voltage source is electrically connected to the transfer portion, and the one of the DC voltage source and the AC voltage source connected to the transfer portion is switched by driving the first relay and the second relay.

25. The image forming apparatus according to claim 24, wherein the controller drives the first relay and the second relay while a voltage output from the DC voltage source and a voltage output from the AC voltage source fall to zero.

* * * * *